US006374426B1

(12) United States Patent
Falchieri

(10) Patent No.: US 6,374,426 B1
(45) Date of Patent: Apr. 23, 2002

(54) DISPENSER FOR THE DOSAGE OF SANITIZING AND/OR DEODORANT LIQUIDS, PARTICULARLY FOR CISTERNS OF TOILET BOWLS

(75) Inventor: Roberto Falchieri, Bologna (IT)

(73) Assignee: FALP S.r.L., Passo Segni Baricella (IT)

( * ) Notice: Subject to any disclaimer, the term of this patent is extended or adjusted under 35 U.S.C. 154(b) by 0 days.

(21) Appl. No.: 09/578,730

(22) Filed: May 26, 2000

(30) Foreign Application Priority Data

Feb. 4, 2000 (IT) ..... B02000A49

(51) Int. Cl.[7] ..... E03D 9/02
(52) U.S. Cl. ..... 4/227.2
(58) Field of Search ..... 4/227.2, 227.6

(56) References Cited

U.S. PATENT DOCUMENTS 915,629 A * 3/1909 Shipp ..... 4/227.2
1,227,997 A * 5/1917 Clifford ..... 4/227.2
1,365,642 A * 1/1921 Amann ..... 4/227.2
4,370,763 A * 2/1983 Dolan ..... 4/227.2
4,512,041 A * 4/1985 Tsai ..... 4/227.2

FOREIGN PATENT DOCUMENTS

FR 2574444 * 6/1986 ..... 4/227.2

* cited by examiner

*Primary Examiner*—Charles E. Phillips
(74) *Attorney, Agent, or Firm*—Guido Modiano; Albert Josif; Daniel O'Byrne

(57) ABSTRACT

A dispenser for the dosage of sanitizing and/or deodorant liquids, particularly for cisterns of toilet bowls, comprising: a container for said liquid, which is adapted to float in the water of a cistern, at an upper level, and is provided, in a peripheral region thereof, with dosage means connected to the outside through at least one opening; supporting means, having one end thereof anchored to fixed parts of said cistern and allowing said container to move from a floating position, which corresponds to said upper level and where said opening is directed upwards, to an active position, where said opening is directed substantially downwards in order to allow to transfer a dose of said liquid when the water in said cistern is emptied.

5 Claims, 5 Drawing Sheets

DISPENSER FOR THE DOSAGE OF SANITIZING AND/OR DEODORANT LIQUIDS, PARTICULARLY FOR CISTERNS OF TOILET BOWLS

BACKGROUND OF THE INVENTION

The present invention relates to a dispenser for the dosage of sanitizing and/or deodorant liquids, particularly for cisterns of toilet bowls.

Conventional kinds of deodorant and/or sanitizing products, applied inside cisterns of toilet bowls in various manners in order to ensure good hygiene of the toilet bowl, are solid and are permanently in contact with the water contained in the cistern, so that they dissolve over a given period of time, releasing the deodorant and/or sanitizing active principle.

A drawback in the use of these products is that they are not particularly adapted for dosage control, since the concentration of the deodorant and/or sanitizing active principle in the water is dependent on the time for which the product is in contact with the water. If the product remains in contact with the water for a long time, an excessive concentration of the active principle in the water as well as total or partial dissolution of the product earlier than the normally planned consumption times occurs. Vice versa, if the product remains in contact with the water for a short time, the concentration of the active principle in the water fails to ensure hygiene of the toilet bowl. These problems therefore show that the concentration of the active principle in the water is a substantially random phenomenon and that it is not possible to have appropriate control of the dosage of said active principle.

SUMMARY OF THE INVENTION

The aim of the present invention is to obviate the above drawbacks of conventional products and to provide a dispenser which allows to solve the above noted problems.

Within the scope of this aim, an object of the present invention is to achieve the above aim with a structure which is simple, relatively easy to provide in practice, safe in use, effective in operation, and having a low cost.

This and other objects are achieved by the dispenser for the dosage of sanitizing and/or deodorant liquids, according to the present invention, particularly for cisterns of toilet bowls, which comprises: a container for said liquid, which is adapted to float in the water of a cistern, at an upper level, and is provided, in a peripheral region thereof, with dosage means connected to the outside through at least one opening; supporting means, having one end thereof anchored to fixed parts anchored of said cistern and allowing the container to move from a floating position, which corresponds to said upper level and where said opening is directed upwards, to an active position, where said opening is directed substantially downwards in order to allow to transfer a dose of said liquid when the water in said cistern is emptied.

BRIEF DESCRIPTION OF THE DRAWINGS

Further characteristics and advantages will become better apparent from the detailed description of a preferred but not exclusive embodiment of a dispenser for the dosage of sanitizing and/or deodorant liquids, particularly for cisterns of toilet bowls, according to the invention, illustrated only by way of non-limitative example in the accompanying drawings, wherein.

DESCRIPTION OF THE PREFERRED EMBODIMENTS

Figure 1:
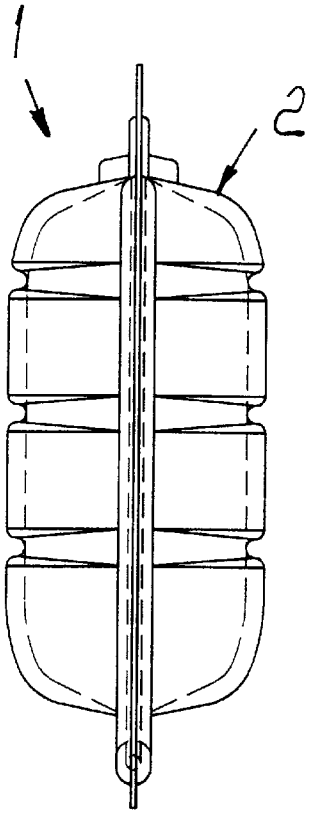
FIG. 1 is a lateral elevation view of the dispenser according to the invention.
Figure 2:
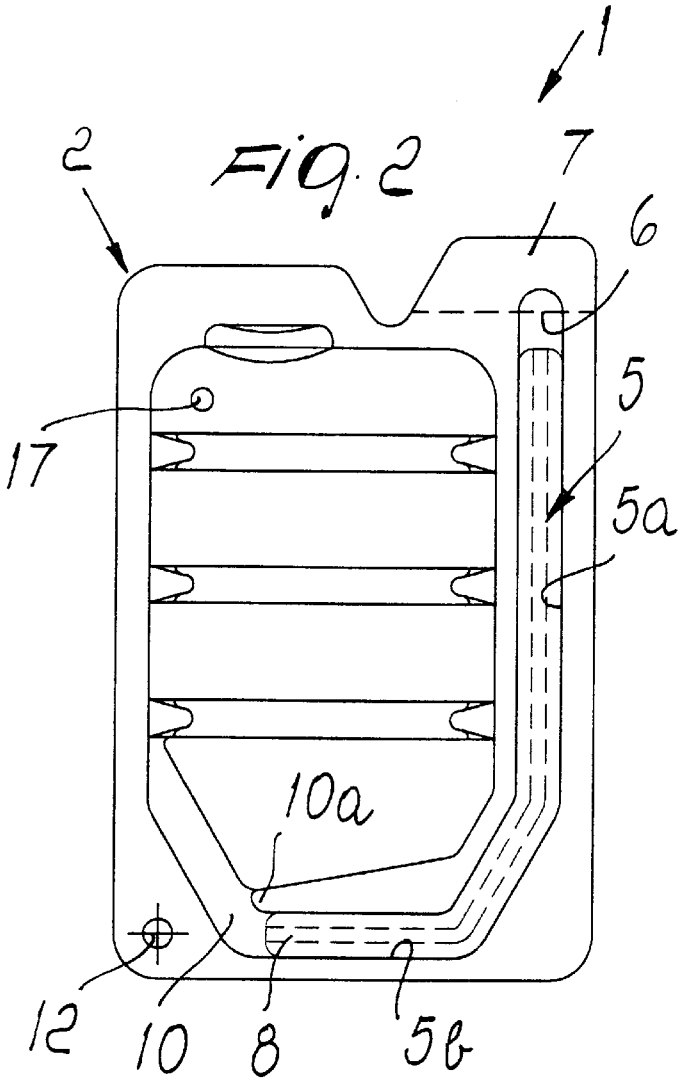
FIG. 2 is a front elevation view of the dispenser of FIG. 1.
Figure 3:
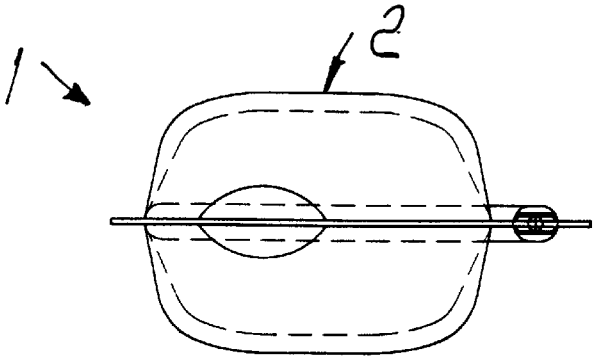
FIG. 3 is a top view of the dispenser of FIG. 1.

With reference to FIGS. 1 to 4, the reference numeral 1 generally designates a dispenser for the dosage of sanitizing and/or deodorant liquids, particularly for cisterns of toilet bowls, according to the invention.

The dispenser 1 comprises a container 2 having a cavity 3 which accommodates a sanitizing and/or deodorant liquid 4. The container 2 has a rectangular shape and is provided, in its peripheral region, with dosage means consisting of a channel 5 whose L-like shape is directed toward the internal cavity 3. The channel 5 forms a first portion 5*a* and a second portion 5*b*. The first portion 5*a* ends with an opening 6 which is closed by a tab 7 which can be detached in order to allow the connection of the dosage means, or of the channel 5, to the outside. The second portion 5b ends with an inlet 8 which is connected to an extraction region 10 which is located on the bottom of the container 1. In the region above the second portion 5*b* there is a sloping surface 11 which has an apex 11 a which protrudes into the extraction region 10.

The container 2 has, in the peripheral region 2*a* that lies opposite the channel 5 proximate to the extraction region 10, a hole 12 which accommodates a pivot 13 adapted to provide the articulation of the container 1 to the end 14*a* of the adjustable rigid rod 14, which is fixed, by means of its other end 14*b*, to fixed parts 15 of the cistern, which is not shown in the accompanying drawings.

Advantageously, proximate to the peripheral region 2*a*, on the opposite side with respect to the hole 12, there is a port 17 to allow the inflow of the air present in the local environment of the cistern.

Figure 4:
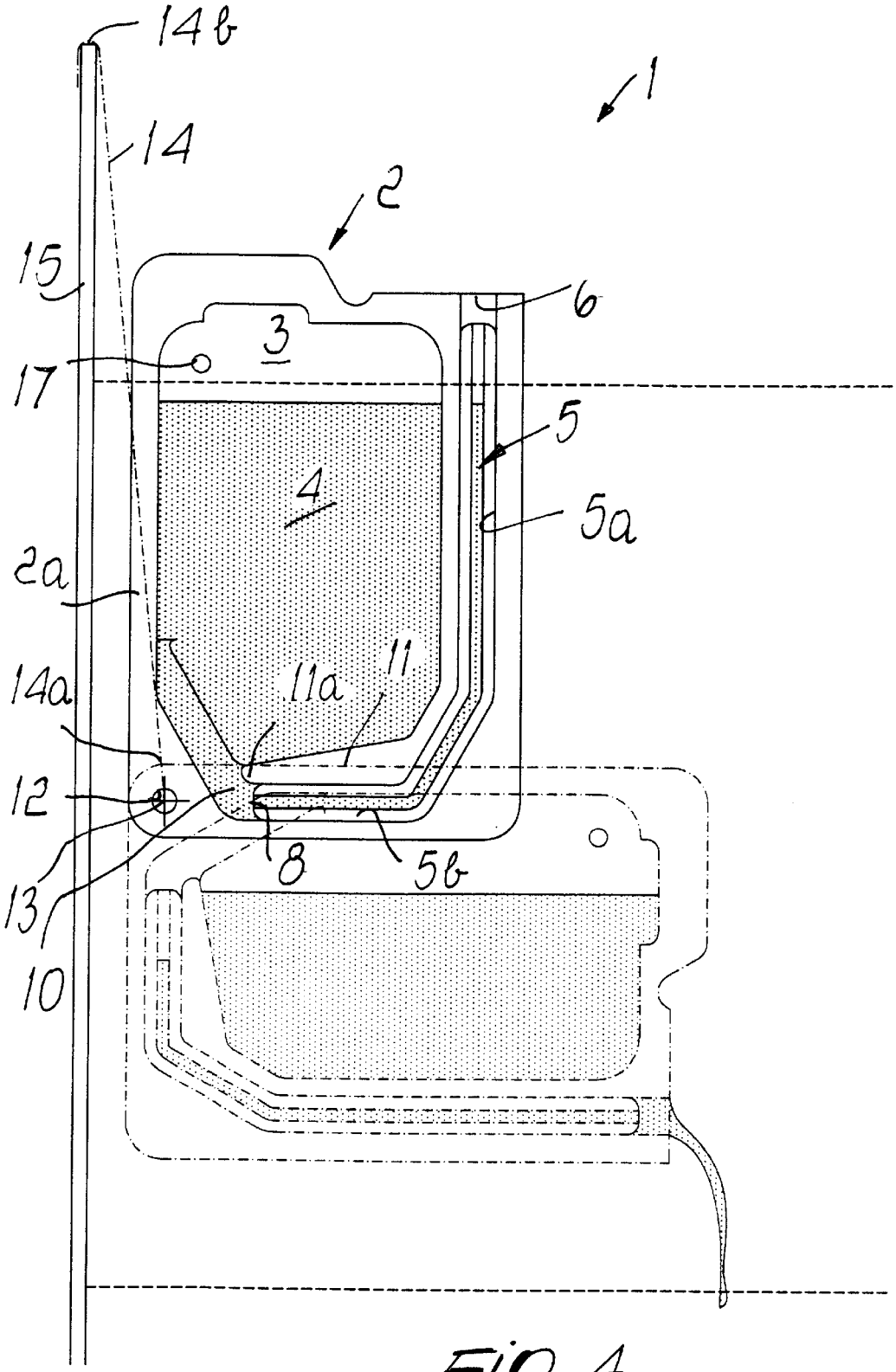
FIG. 4 is a view of the dispenser applied to a cistern in a floating position and in an active position.

In practical operation, with reference to FIG. 4, the dispenser 1 is arranged in the cistern, the tab 7 is removed in order to connect the opening 6 to the outside of the local environment, and an adhesive portion that covers the port 17 through which air enters the cavity 3 of the container 1 is removed. In this situation, when the cistern is filled with water up to a first upper level, the dispenser 1, and particularly the container 2, float, determining the floating position at which the opening 6 is directed upwards. In this situation, the liquid 4, assisted by the sloping surface 11 and by the extraction region 10, is transferred through the inlet 8 into the channel 5, flowing toward the opening 6 until it fills the channel 5 to the level of the free surface of the liquid 4 enclosed in the container 2. The filling of the channel 5 determines, in quantitative terms, a dose which is released when, upon discharge of the water of the cistern, the container 2 turns through 90° about the axis defined by the pivot 12, moving from the floating position to an active position in which the opening 6 is in practice directed downwards.

The dispenser according to the invention thus conceived is susceptible of numerous modifications and variations, all of which are within the scope of the appended claims.

Figure 5:
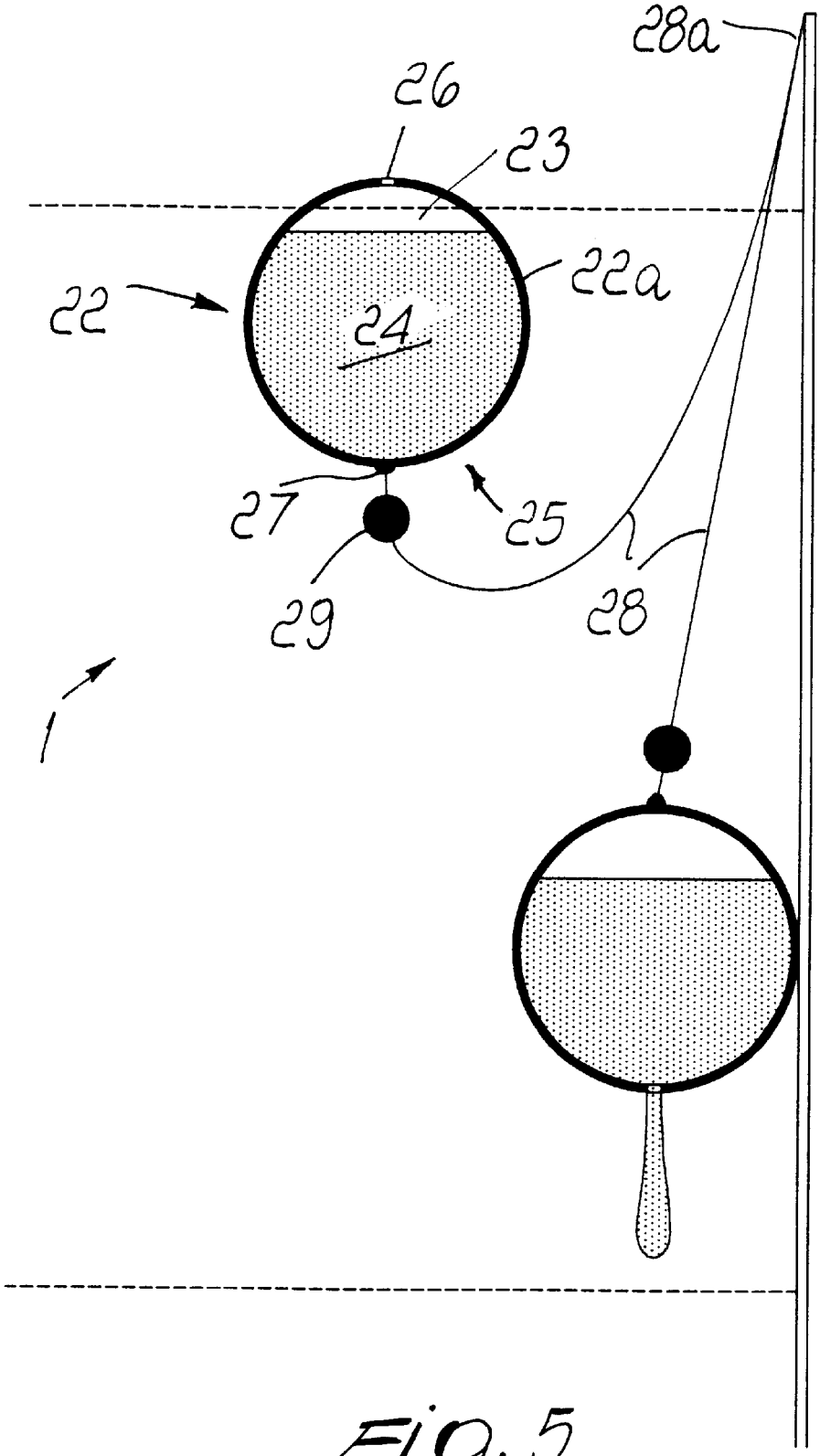
FIG. 5 is a view of a second embodiment of the dispenser according to the invention.

In particular, a second embodiment is shown in FIG. 5, in which the container 22 is spherical and encloses the liquid 24 in the spherical cavity 23. Along the peripheral region 22*a*, the dosage means are formed by one or more openings 26, and a coupling 27 adapted for connecting the container 22 to the supporting means is correspondingly provided on the hemisphere 25 that lies diametrically opposite the opening 26. The supporting means comprise an inextensible cord 28 whose length can be adjusted; the cord is anchored to fixed parts of the cistern with one end 28*a* and to the coupling 27 with its other end 28*b*.

Along the cord 28, proximate to the coupling 27, there is a ballast 29 which, in the floating position of the container 22, is arranged vertically downwards by gravity, arranging the opening 26 vertically upwards, since the opening 26 lies diametrically opposite the ballast 29.

When the water of the cistern is emptied, the container 22, with the aid of the cord 28, moves from the floating position to the active position, in which it directs the opening 26 downwards, releasing a dose of the sanitizing and/or deodorant liquid 4.

Figure 6:
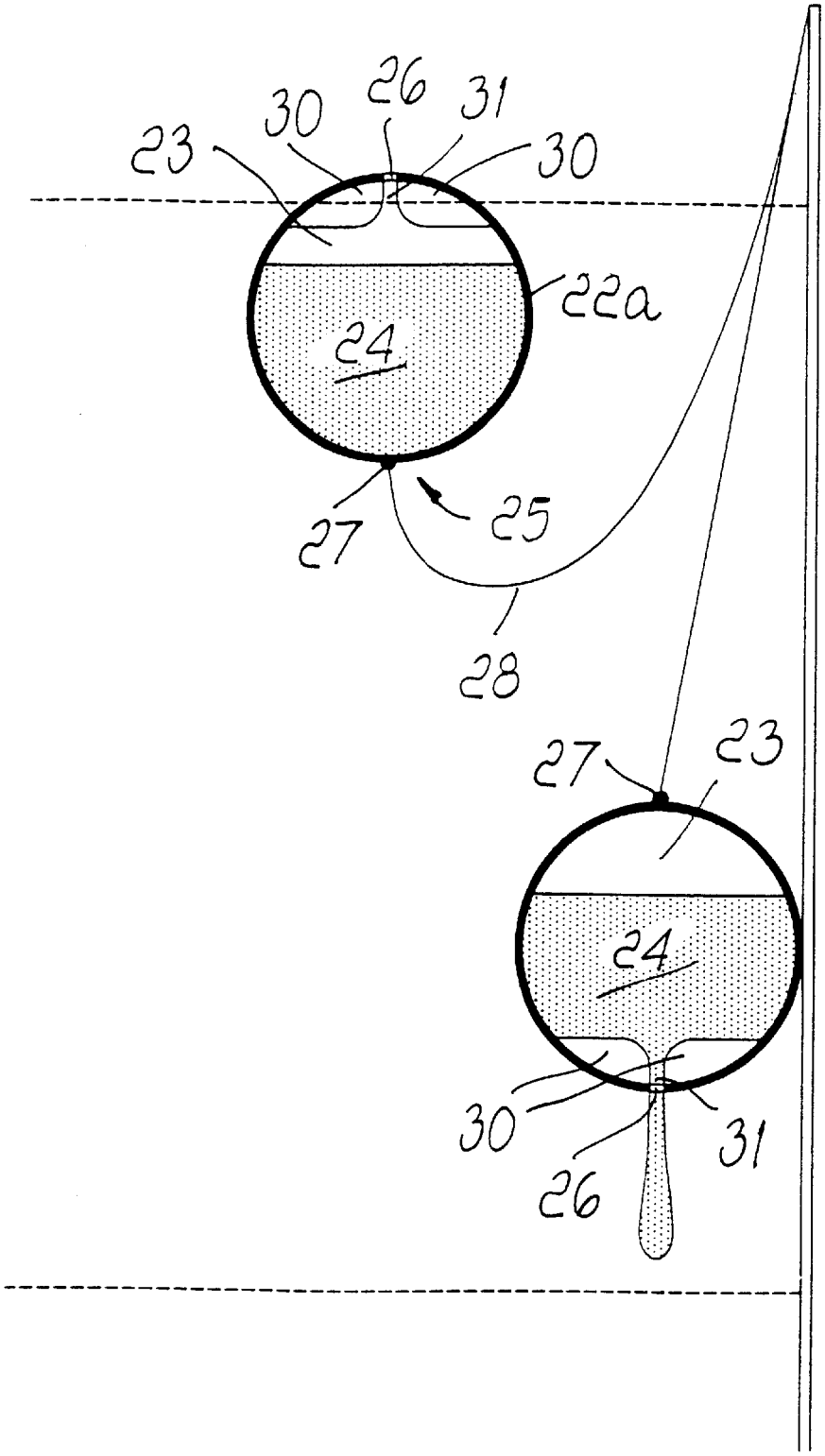
FIG. 6 is a view of a third embodiment of the dispenser according to the invention.

A third embodiment of the invention is shown in FIG. 6, in which the container 22 is spherical and internally encloses the liquid 24 in the spherical cavity 23. Along the peripheral region 22*a*, the dosage means are provided by one or more openings 26, and adjacent thereto there are, in the spherical cavity, empty chambers 30 which form a channel 31 which connects the spherical cavity 23 to the opening 26.

The empty chambers 20, like the ballast 29, are adapted to direct the opening 26 upwards at the floating position of the container 22.

When the water of the cistern is emptied, the container 22, with the aid of the cord 28, moves from the floating position to the working position, in which it directs the opening 26 downwards, releasing a dose of the sanitizing and/or deodorant liquid.

Figure 7:
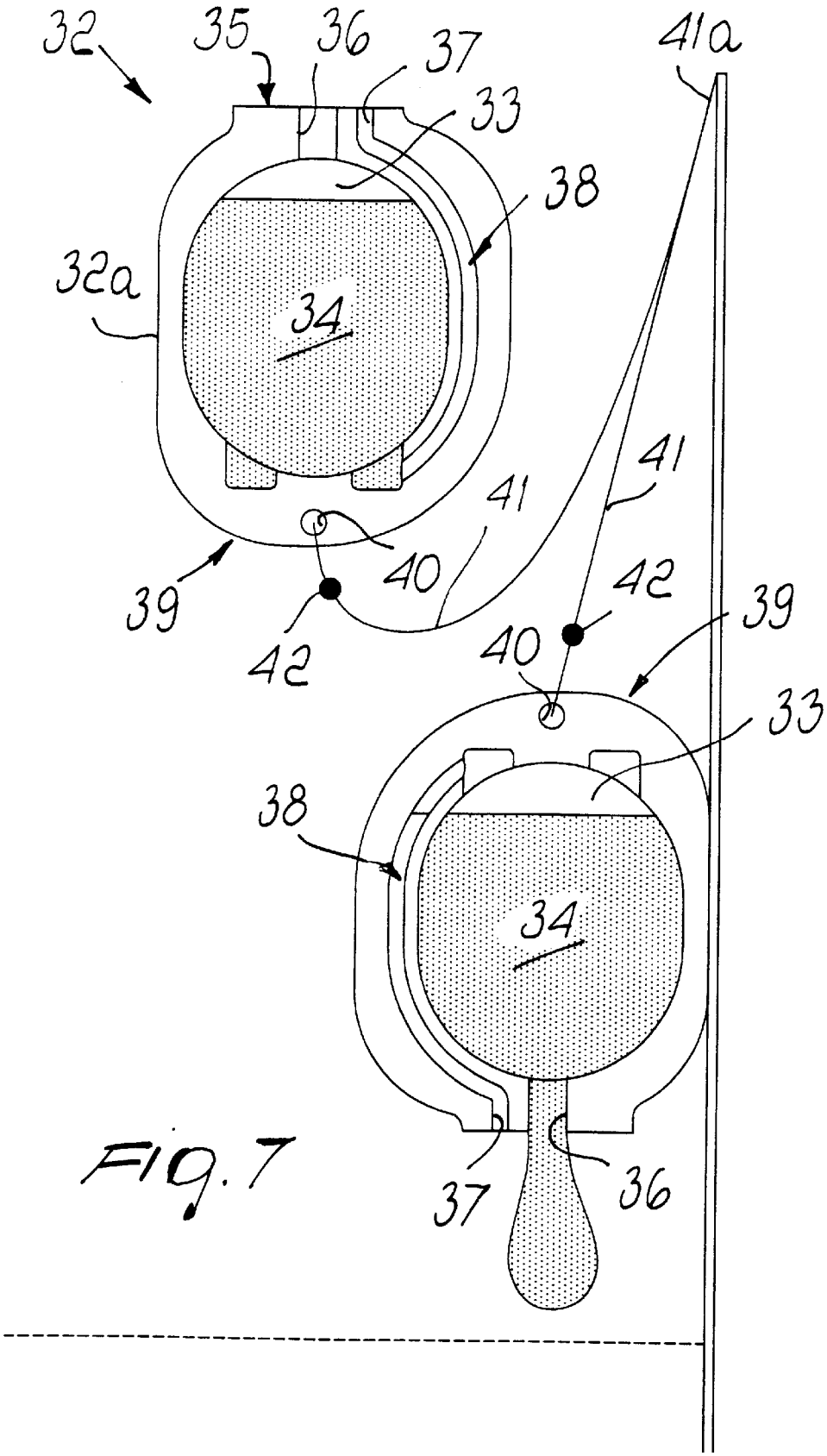
FIG. 7 is a view of a fourth embodiment of the dispenser.

A fourth embodiment is shown in FIG. 7, in which the container 32 is oval and internally encloses the liquid 34 in the cavity 33. Along the peripheral region 32*a*, and particularly at the hemisphere 35, there are dosage means, which comprise an opening 36 for the dosage of the liquid 34 and by an opening 37 which is connected to the cavity 33 by means of a duct 38 which runs along the peripheral portion 32*a* that lies between the opposite hemispheres 35 and 39. At the hemisphere 39 there is a coupling 40 which is adapted to connect the container 22 to the supporting means. The supporting means comprise an inextensible cord 41 whose length can be adjusted; said cord is anchored to fixed parts of the cistern with one end 41*a* and to the coupling 40 with its other end.

Along the cord 41, proximate to the coupling 40, there is a ballast 42 which in the floating position of the container 32 is arranged vertically downwards by gravity, directing the openings 36 and 37 vertically upwards, since the openings 36 and 37 are arranged opposite the ballast 42.

When the water of the cistern is emptied, the container 32, with the aid of the cord 41, moves from the floating position to the active position, in which it directs the openings 36 and 37 downwards, releasing through the opening 36 a dose of the liquid 34 into the cistern and allowing the air that is locally present to enter, through the opening 37 and the duct 38, the cavity 33 of the container 32.

From the above description it is evident that the invention achieves the intended aim and object; in particular, the fact is stressed that the dosage and release of the liquid in the cistern is practically constant over time, regardless of the manner in which the toilet is used.

A further advantage of the invention is the fact that the dosage means release a dose of the sanitizing liquid at each use.

Another advantage is that if the cistern remains without water, the particular configuration of the dosage means prevents the container from emptying.

All the details may furthermore be replaced with other technically equivalent ones.

In practice, the materials used, as well as the shapes and the dimensions, may be any according to requirements without thereby abandoning the scope of the protection of the appended claims.

The disclosures in Italian Patent Application No. BO2000A000049 from which this application claims priority are incorporated herein by reference.

What is claimed is:

1. A dispenser for the dosage of sanitizing and/or deodorant liquids, particularly for cisterns of toilet bowls, comprising: a container for said liquid, which is adapted to float in the water of a cistern, at an upper level, and is provided, in a peripheral region thereof, with dosage means connected to the outside through at least one opening; supporting means, having one end thereof anchored to fixed parts of said cistern and allowing said contained to move from a floating position, which corresponds to said upper level and where said opening is directed upwards, to an active position, where said opening is directed substantially downwards in order to allow to transfer a dose of said liquid when the water in said cistern is emptied, wherein said dosage means consist of a channel having an L-like shape directed toward the inside of said container, said channel forming a first portion which ends with said opening and a second portion which ends with an inlet and wherein in a region above said second portion a sloping surface is provided which has an apex protruding into said inlet region and adapted to prevent the passage of said fluid in said inlet region in said active position.

2. The dosage dispenser according to claim 1, wherein said opening has a section which allows transfer of a dose of said sanitizing liquid.

3. The dosage dispenser according to claim 1, wherein said container is rotatably connected, at a peripheral region that lies opposite said dosage means, by way of a pivot, to another end of said supporting means.

4. The dosage dispenser according to claim 1, wherein said supporting means comprise a rod whose length is adjusable in order to allow adaptation to the level of the water of said cistern.

5. The dosage dispenser according to claim 1, wherein said inlet is connected to an extraction region adapted to allow, in the floating position, filling of said channel.

* * * * *